US010479566B2

(12) United States Patent
Doyle et al.

(10) Patent No.: US 10,479,566 B2
(45) Date of Patent: Nov. 19, 2019

(54) CONTAINER APPARATUS

(71) Applicant: BeeHaven Tribe, Fountain Valley, CA (US)

(72) Inventors: Anesa Rebecca Doyle, Fountain Valley, CA (US); Joseph Gordon Doyle, Fountain Valley, CA (US)

(73) Assignee: BeeHaven Tribe, Fountain Valley, CA (US)

( * ) Notice: Subject to any disclaimer, the term of this patent is extended or adjusted under 35 U.S.C. 154(b) by 0 days.

(21) Appl. No.: 16/281,028

(22) Filed: Feb. 20, 2019

(65) Prior Publication Data

US 2019/0177047 A1 Jun. 13, 2019

Related U.S. Application Data

(63) Continuation of application No. PCT/US2017/049942, filed on Sep. 1, 2017.

(60) Provisional application No. 62/409,882, filed on Oct. 19, 2016.

(51) Int. Cl.

| | |
|---|---|
| ***B65D 43/26*** | (2006.01) |
| ***B65D 25/04*** | (2006.01) |
| ***B65D 83/04*** | (2006.01) |
| ***B65D 47/26*** | (2006.01) |
| ***B65D 1/36*** | (2006.01) |
| ***B65D 85/00*** | (2006.01) |

(52) U.S. Cl.

CPC ..... *B65D 43/26* (2013.01); *B65D 1/36* (2013.01); *B65D 25/04* (2013.01); *B65D 47/265* (2013.01); *B65D 83/0454* (2013.01); *B65D 85/70* (2013.01)

(58) Field of Classification Search

CPC .... B65D 83/0454; B65D 2215/00; A61J 7/04; G07F 11/54

See application file for complete search history.

(56) References Cited

U.S. PATENT DOCUMENTS

| | | | | |
|---|---|---|---|---|
| 3,412,890 | A | 11/1968 | Rich | |
| 5,226,539 | A | 7/1993 | Cheng | |
| 5,322,166 | A * | 6/1994 | Crowther ..... | B65D 83/0454 206/534 |
| 5,664,697 | A | 9/1997 | Lambelet, Jr. et al. | |
| 6,349,671 | B1 | 2/2002 | Lewis et al. | |

(Continued)

OTHER PUBLICATIONS

International Search Report and Written Opinion, PCT/US2017/049942, dated Jan. 12, 2018.

*Primary Examiner* — Jeffrey R Allen

(74) *Attorney, Agent, or Firm* — Entralta P.C.; Justin G. Sanders; Peter D. Weinstein

(57) ABSTRACT

A container apparatus is disclosed. In at least one embodiment, a container provides a plurality of compartments radially arranged about the container, each of the compartments being sized and configured for removably receiving an at least one item. A cover is rotatably engagable with the container and configured for selectively covering and preventing access into at least one of the compartments. The cover defines an at least one cutout positioned and configured for selectively exposing at least one compartment of the container, thereby allowing access into said at least one compartment. In use, the apparatus is configured for allowing selective rotary motion of the container relative to the cover in a correct direction, while substantially preventing motion in an opposing incorrect direction.

19 Claims, 13 Drawing Sheets

(56) References Cited

U.S. PATENT DOCUMENTS

| | | | | |
|---|---|---|---|---|
| 6,352,258 | B1 | 3/2002 | Fitzgerald et al. | |
| 6,669,022 | B2 | 12/2003 | Donegan | |
| 2003/0094345 | A1* | 5/2003 | Munini | A45C 1/02 194/338 |
| 2005/0205595 | A1* | 9/2005 | Lepke | B65D 83/0454 221/87 |
| 2006/0151517 | A1 | 7/2006 | Varis | |

* cited by examiner

CONTAINER APPARATUS

RELATED APPLICATIONS

This application is a continuation application and so claims priority pursuant to 35 U.S.C. § 120 to prior filed and co-pending international application number PCT/US2017/049942, filed on Sep. 1, 2017, which itself claims priority pursuant to 35 U.S.C. § 119(e) and is entitled to the filing date of U.S. provisional patent application Ser. No. 62/409,882, filed on Oct. 19, 2016. The contents of the aforementioned applications are incorporated herein by reference.

BACKGROUND

The subject of this patent application relates generally to containers, and more particularly to a container apparatus providing a compartmentalized container and a ratcheting cover rotatably engagable therewith, the cover configured for selectively covering and preventing access into a portion of the container.

Applicant hereby incorporates herein by reference any and all patents and published patent applications cited or referred to in this application.

By way of background, it is often difficult for parents and guardians (hereinafter referred to generally as "guardians" for simplicity purposes) to manage the order in which a child consumes a plurality of different foods that are provided on a single plate during meal time, given that all such foods are accessible to the child at once. It becomes even more difficult when the guardian is occupied with eating their own meal. As a result, unless heavily supervised by the guardian, the child will likely eat the most desirable food first, then consume the next desirable food, and so on—regardless of the relative healthiness of each food item. Children also become less motivated to continue to eat the food presented on a plate as less and less desirable food remains and the child's hunger decreases. Due to the prevalence of processed and unhealthy foods targeted towards children, it is common that food with relatively low nutritional value is consumed first while relatively high nutritional value or healthy food remains on the plate, not consumed. Eating in this manner will not only hinder the health and well-being of the child, but it will limit the exposure to foods which the child would consider eating if not for the presence of relatively more desirable, less healthy food; this, in turn, causes a behavior which allows a selective scope of healthy food to be consumed in the child's diet and an increased risk of health issues throughout the child's life.

Accordingly, there continues to be a need for a solution that aids in the modification of eating habits by providing a sequential order in which food is accessible by the child, thereby requiring the child to eat relatively healthier foods first or, alternatively, requiring the child to eat balanced portions of foods. Aspects of the present invention fulfill these needs and provide further related advantages as described in the following summary.

SUMMARY

Aspects of the present invention teach certain benefits in construction and use which give rise to the exemplary advantages described below.

The present invention solves the problems described above by providing a container apparatus providing a compartmentalized container and a ratcheting cover rotatably engagable therewith. In at least one embodiment, a container provides a plurality of compartments radially arranged about the container, each of the compartments being sized and configured for removably receiving an at least one item. A cover is rotatably engagable with the container and configured for selectively covering and preventing access into at least one of the compartments. The cover defines an at least one cutout positioned and configured for selectively exposing at least one compartment of the container, thereby allowing access into said at least one compartment. In use, the apparatus is configured for allowing selective rotary motion of the container relative to the cover in a correct direction, while substantially preventing motion in an opposing incorrect direction.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments.

DETAILED DESCRIPTION

Figure 1:
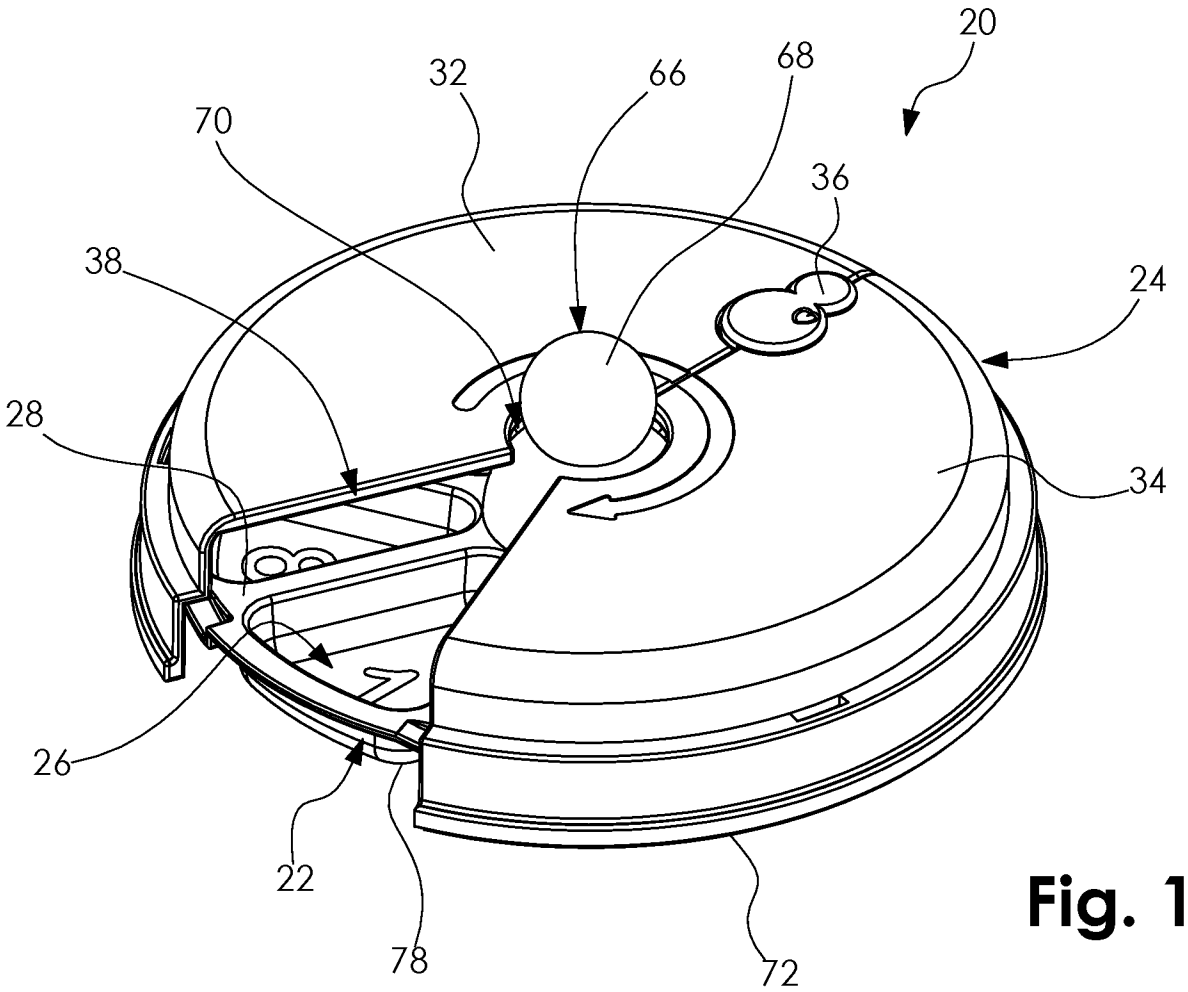
FIG. 1 is a perspective view of an exemplary container apparatus, in accordance with at least one embodiment.
Figure 2:
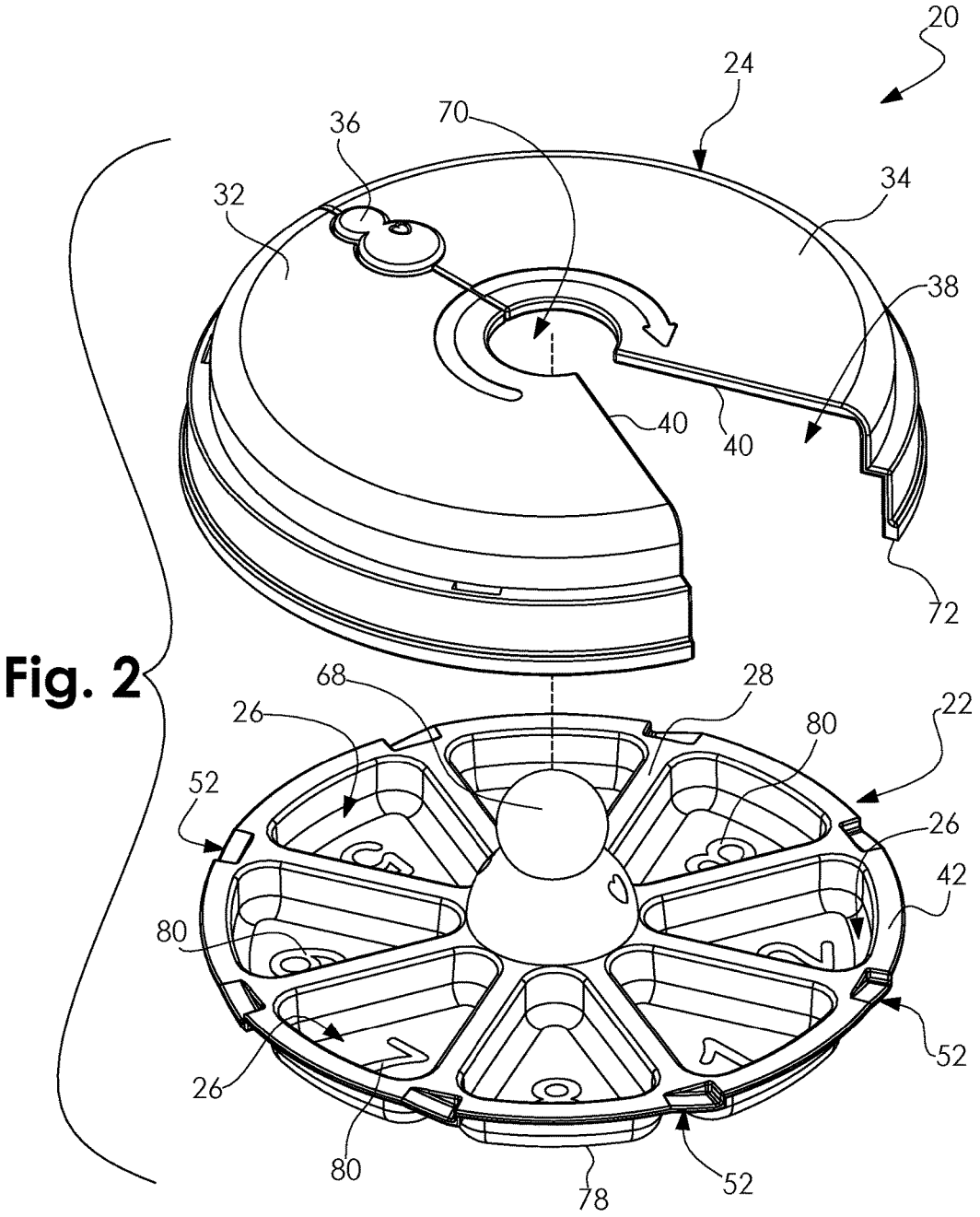
FIG. 2 is an exploded view thereof, in accordance with at least one embodiment.
Figure 3:
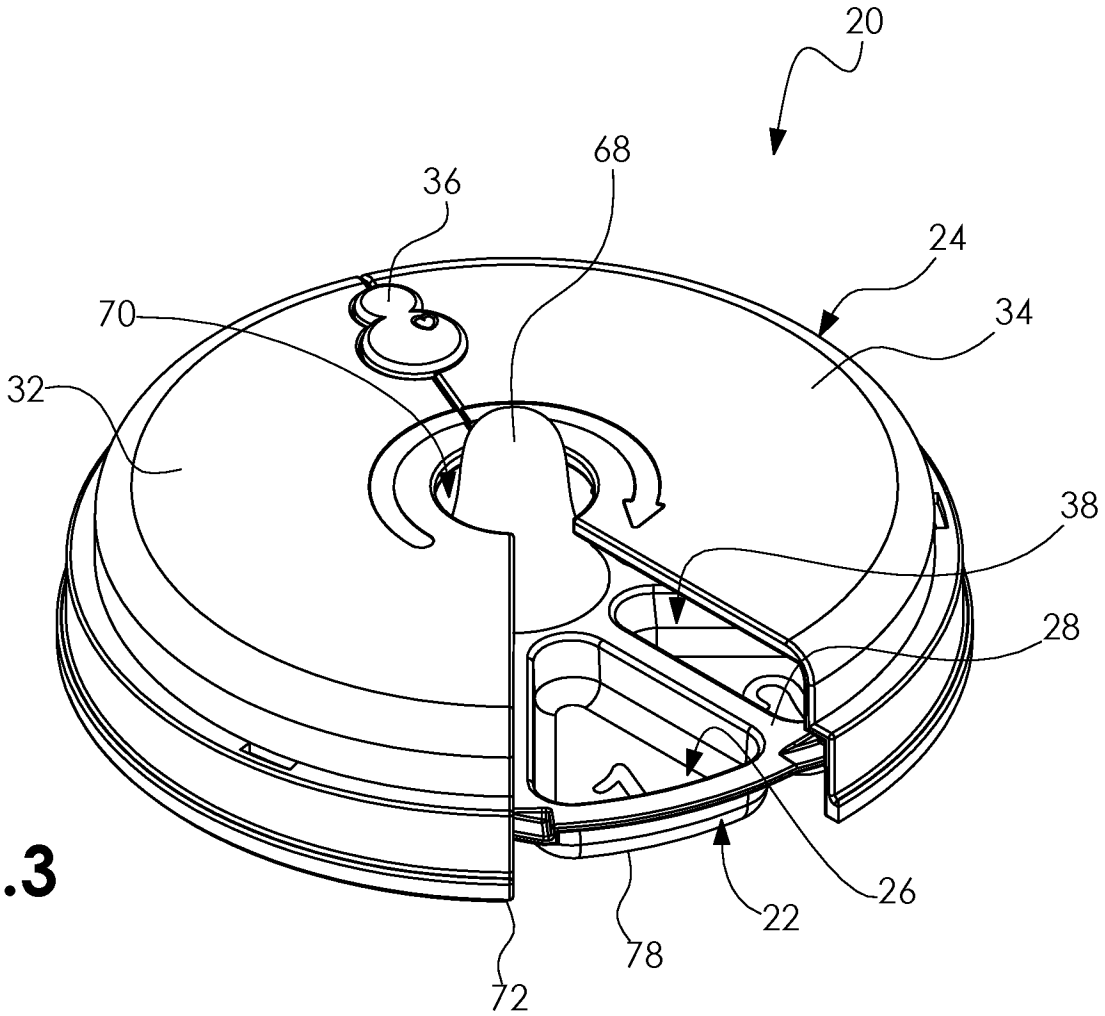
FIG. 3 is a perspective view of a further exemplary container apparatus, in accordance with at least one embodiment.
Figure 4:
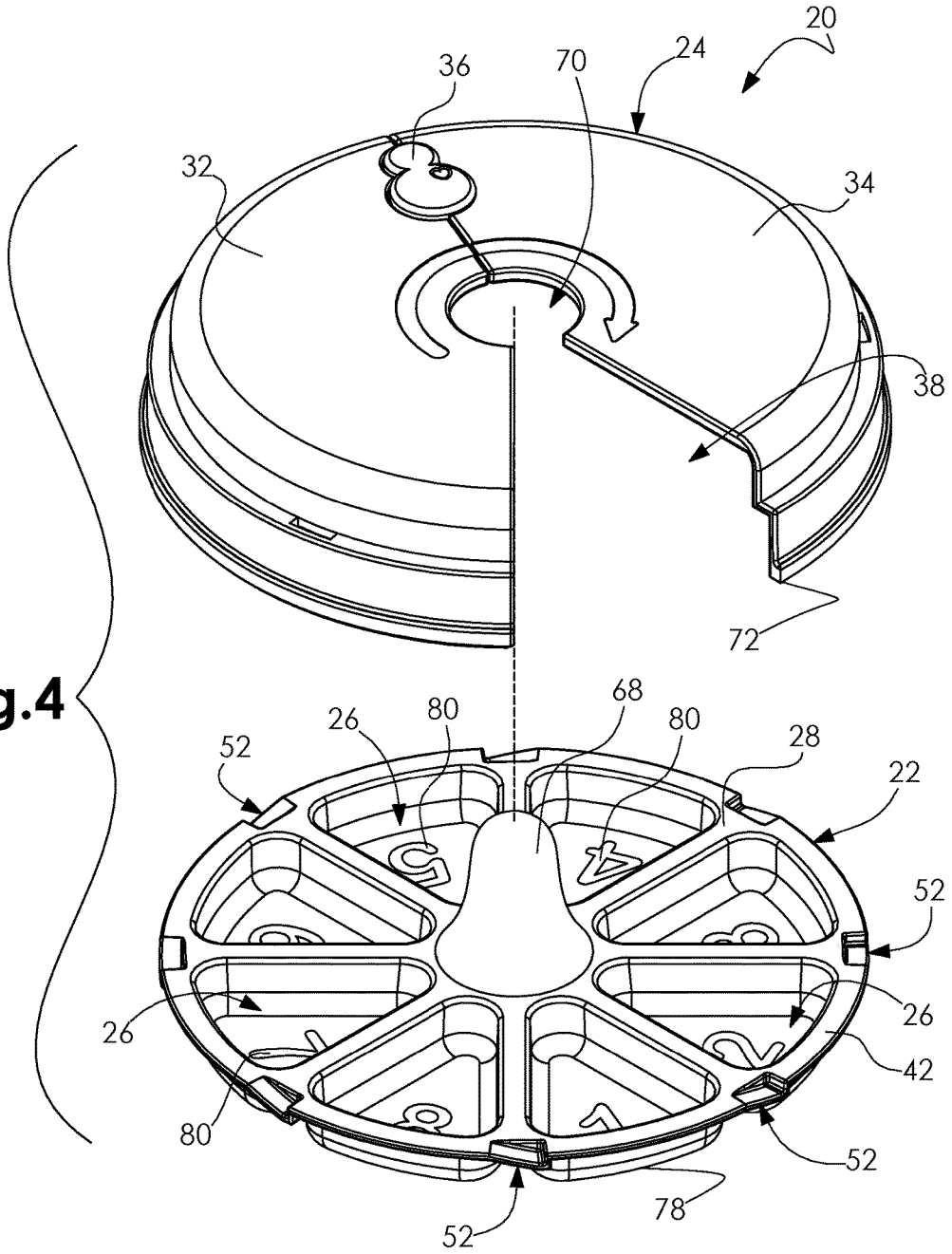
FIG. 4 is an exploded view thereof, in accordance with at least one embodiment.
Figure 5:
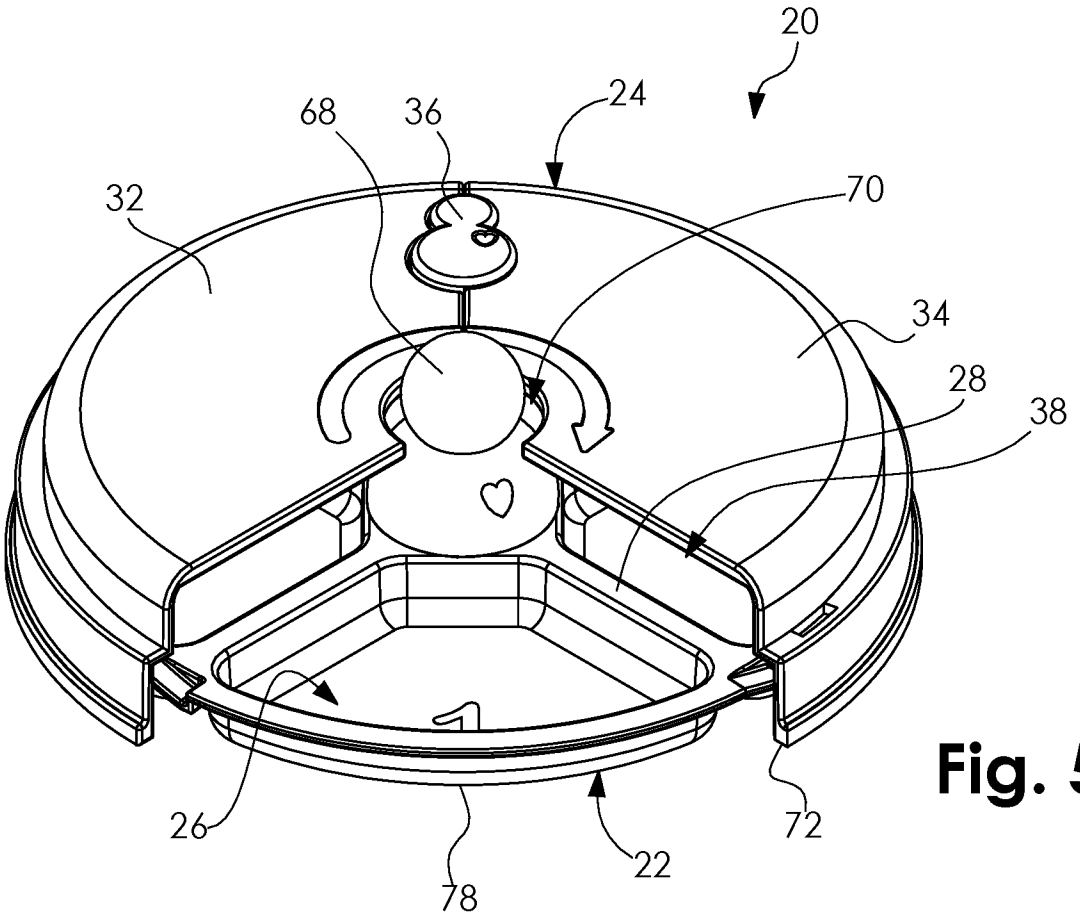
FIG. 5 is a perspective view of a still further exemplary container apparatus, in accordance with at least one embodiment.
Figure 6:
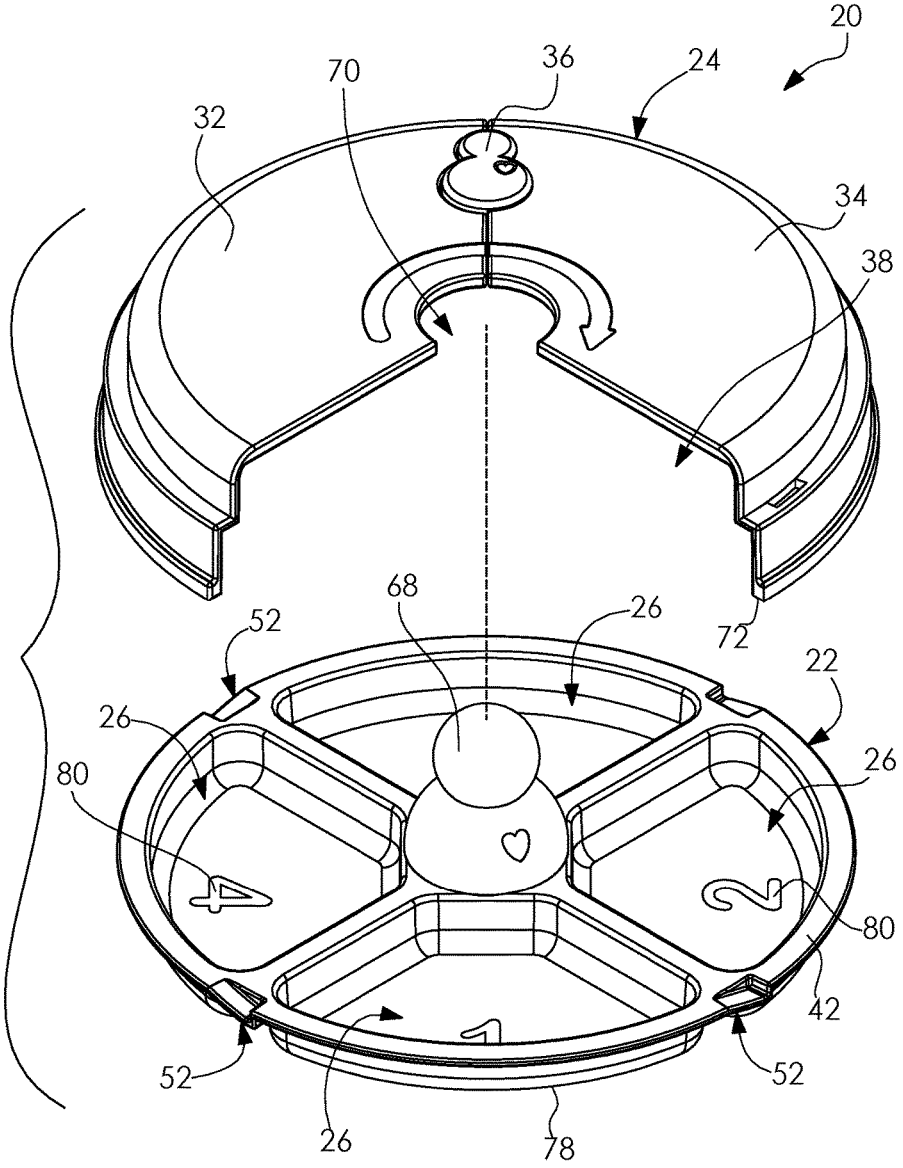
FIG. 6 is an exploded view thereof, in accordance with at least one embodiment.
Figure 7:
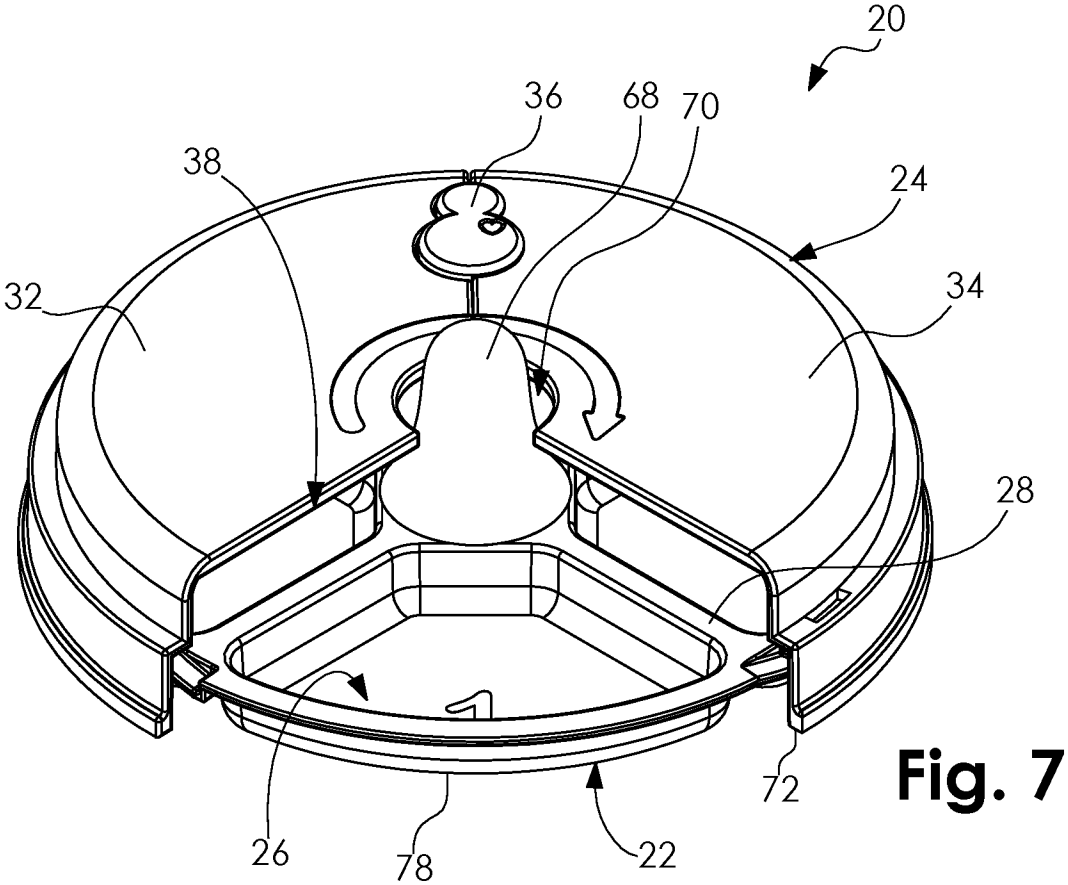
FIG. 7 is a perspective view of a still further exemplary container apparatus, in accordance with at least one embodiment.
Figure 8:
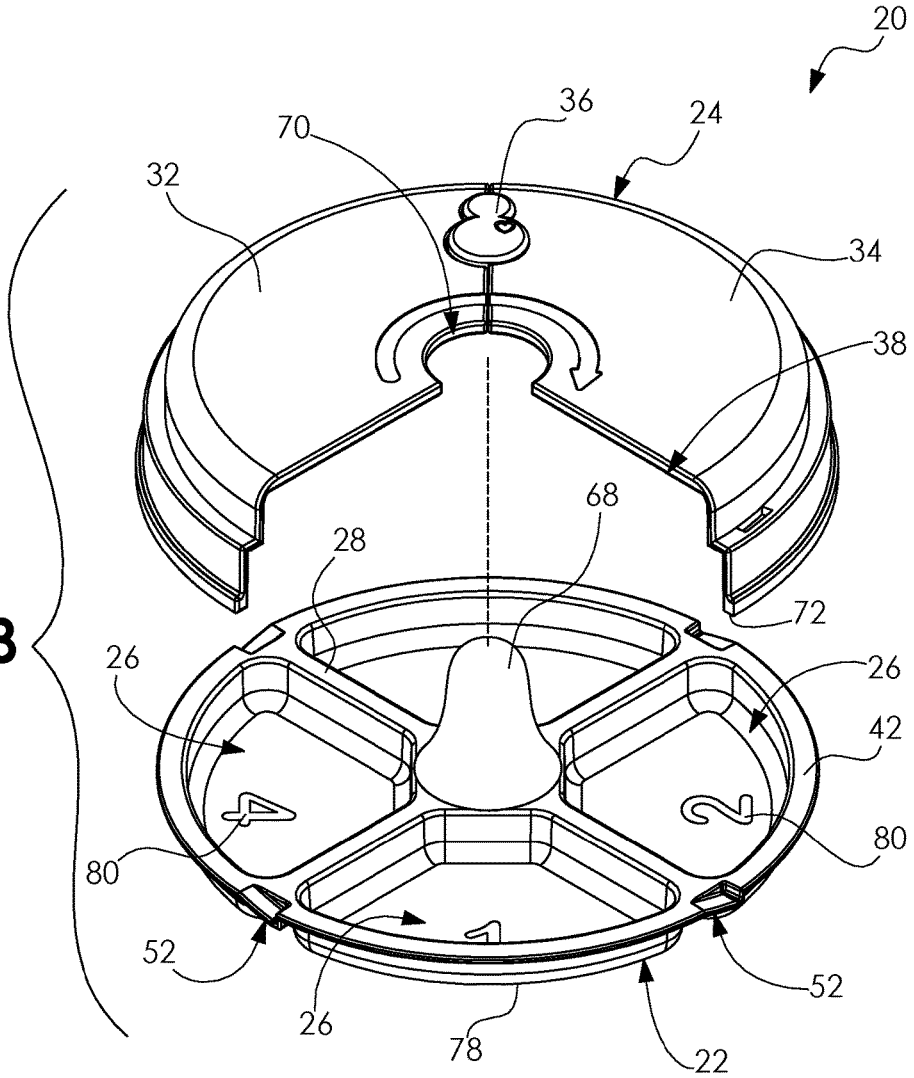
FIG. 8 is an exploded view thereof, in accordance with at least one embodiment.
Figure 10:
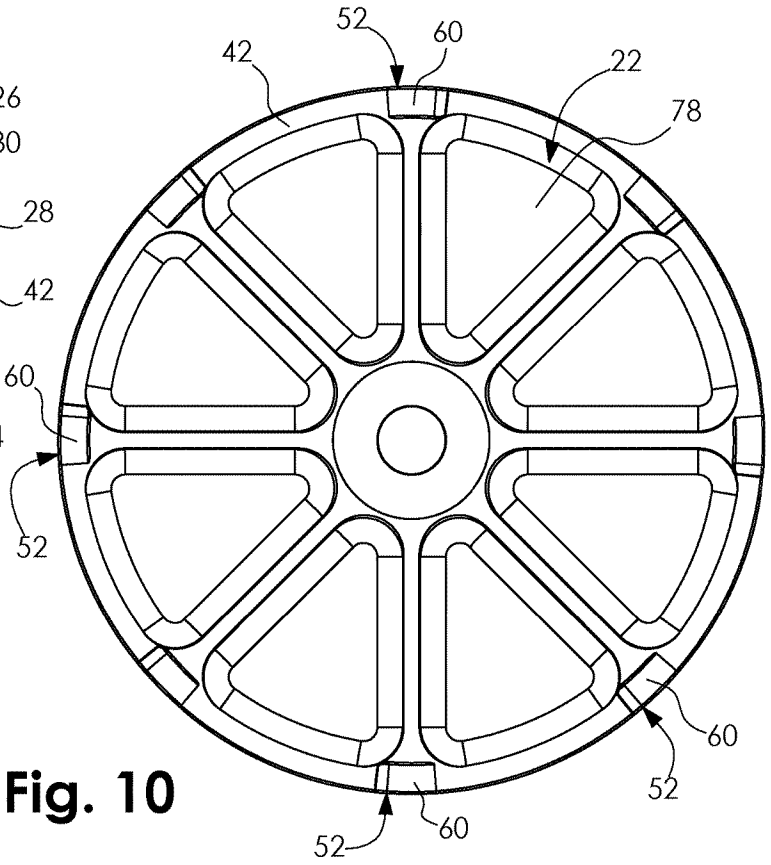
FIG. 10 is a bottom view thereof, in accordance with at least one embodiment.

Turning now to FIG. 1, there is shown a perspective view of an exemplary container apparatus 20. In at least one embodiment, the apparatus 20 provides a compartmentalized container 22 and a ratcheting cover 24 rotatably engagable with the container 22 and configured for selectively covering and preventing access into a portion of the container 22. In at least one embodiment, as shown in FIG. 2, the container 22 provides a plurality of compartments 26 radially arranged about the container 22, each of the compartments 26 being sized and configured for removably receiving desired items. In that regard, while the apparatus 20 is described herein primarily in the context of food-related items for illustrative purposes, it should be noted that, in at least one further embodiment, the apparatus 20 may be used in any other context—now known or later conceived—where there is a desire to have the user access items in a progressive or sequential manner.

In at least one embodiment, the container 22 provides a substantially planar top surface 28 (similar to that of a traditional plate), with each of the compartments 26 being recessed within the top surface 28 of the container 22. In at least one such embodiment (not shown), each of the compartments 26 is removably positionable within a corresponding aperture in the top surface 28 of the container 22. In at least one alternate embodiment, the container 22 provides a substantially planar top surface 28, with each of the compartments 26 being defined by spaced apart partitions extending upwardly from the top surface 28 of the container 22. In at least one further alternate embodiment, the top surface 28 of the container 22 is concave (similar to that of a traditional bowl or other concave container), with each of the compartments 26 being defined by spaced apart partitions extending upwardly from the top surface 28 of the container 22. Accordingly, it should be understood that the particular size, shape and dimensions of the container 22 shown in the drawings is merely exemplary. Thus, in further embodiments, the container 22 may take on any other size, shape or dimensions—now known or later developed—so long as the apparatus 20 is capable of substantially carrying out the functionality described herein. Similarly, it should be understood that the particular sizes, shapes, dimensions and quantities of compartments 26 shown in the drawings—including the further embodiments illustrated in FIGS. 3-8—are merely exemplary. Thus, in further embodiments, the compartments 26 may take on any other size, shape, dimensions or quantities—now known or later developed—so long as the apparatus 20 is capable of substantially carrying out the functionality described herein. Furthermore, while the compartments 26 are depicted in the drawings as each having the same size, shape and dimensions, in further embodiments, one or more of the compartments 26 may have varying sizes, shapes and/or dimensions relative to the other compartments 26.

Figure 11:
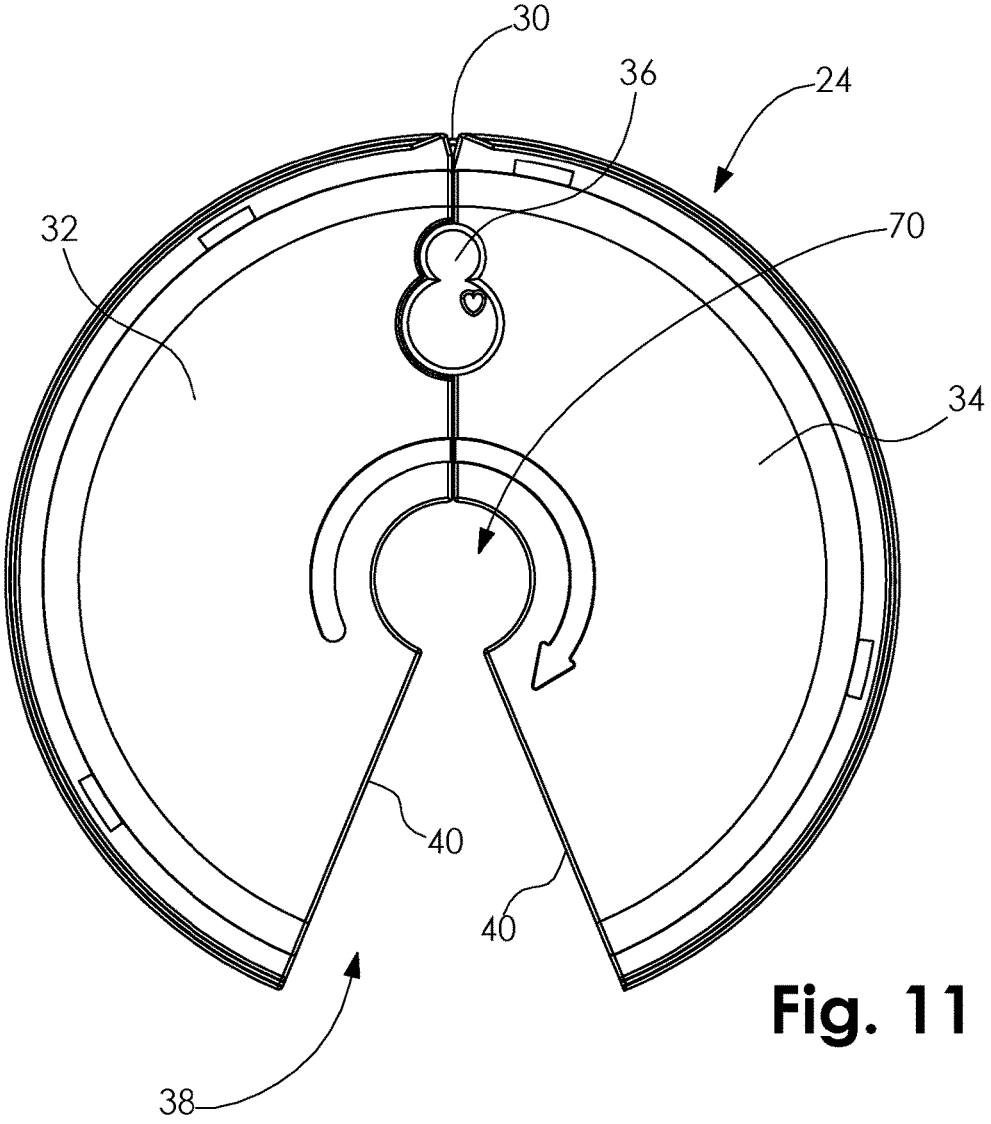
FIG. 11 is a top view of the exemplary cover in a closed position, in accordance with at least one embodiment.
Figure 12:
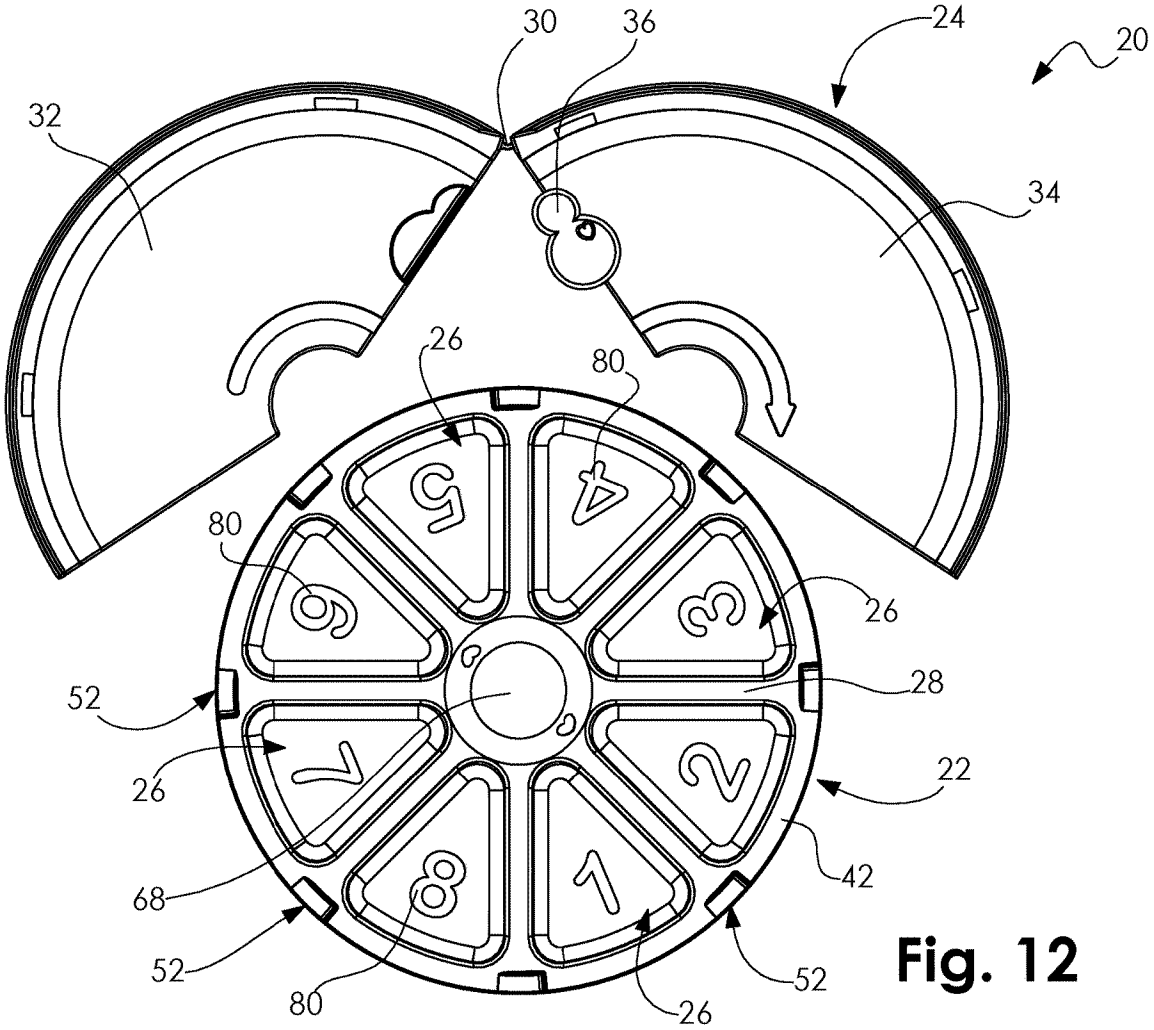
FIG. 12 is a top view of the exemplary cover in an open position, in accordance with at least one embodiment.

As mentioned above, the cover 24 is configured for selectively covering and preventing access into a portion of the container 22. In at least one embodiment, the cover 24 is constructed out of an opaque material so as to prevent visual access into the container 22 as well. However, in at least one further embodiment, the cover 24 is constructed out of a transparent or translucent material, or any combination of opaque, transparent and/or translucent materials. In at least one embodiment, the cover 24 is sized and shaped for approximating the dimensions of the container 22, as illustrated in FIG. 1, while allowing the container 22 to selectively rotate relative to the cover 24. However, it should be understood that the particular size, shape and dimensions of the cover 24 shown in the drawings is merely exemplary. Thus, in further embodiments, the cover 24 may take on any other size, shape or dimensions—now known or later developed—so long as the apparatus 20 is capable of substantially carrying out the functionality described herein; said size, shape and dimensions dictated at least in part by the corresponding size, shape and dimensions of the container 22, in at least one embodiment. In at least one embodiment, the cover 24 is removably engagable with the container 22, which facilitates in placing items in each of the compartments 26 as well as cleaning the container 22, along with the cover 24, when the apparatus 20 is not in use. In at least one such embodiment, as best illustrated in FIGS. 11 and 12, the cover 24 provides an at least one hinge 30 positioned and configured for allowing the cover 24 to selectively move between one of a closed position (FIGS. 11 and 13B)—wherein a first half 32 of the cover 24 is in abutting contact with an opposing second half 34 of the cover 24—and an open position (FIG. 12)—wherein the first and second halves 32 and 34 of the cover 24 are pivoted away from one another. Accordingly, the cover 24 is able to be selectively moved into the open position to allow the container 22 to be positioned between the first and second halves 32 and 34, then subsequently moved into the closed position to retain the container 22 therewithin; and after use, the cover 24 may be moved into the open position once again to allow the container 22 to be removed therefrom. In at least one such embodiment, the cover 24 further provides an at least one latch 36 positioned and configured for preventing the cover 24 from unintentionally moving into the open position during use of the apparatus 20. It should be noted that the particular size, shape, dimensions, relative position and quantity of each of the at least one hinge 30 and latch 36 depicted in the accompanying drawings are merely exemplary and shown for illustrative purposes. In further embodiments, each of the at least one hinge 30 and latch 36 may take on any other size, shape, dimensions, quantity or relative position—now known or later conceived—so long as the apparatus 20 is capable of substantially carrying out the functionality described herein. Additionally, in still further embodiments, the at least one hinge 30 may take on any other hinge-like mechanism, structure or combination thereof—now known or later developed. In still further embodiments, any other mechanism, structure, or combination thereof—now known or later developed—capable of allowing the cover 24 to be removably engagable with the container 22 may be substituted. In at least one still further embodiment, the cover 24 is inseparable from the container 22.

In at least one embodiment, as illustrated best in FIGS. 1 and 2, the cover 24 defines an at least one cutout 38 positioned and configured for selectively exposing at least one compartment 26 of the container 22, thereby allowing access into said at least one compartment 26. In at least one such embodiment, each of the at least one cutout 38 is positioned and configured for selectively exposing a single compartment 26 of the container 22. In at least one further such embodiment, each of the at least one cutout 38 is positioned and configured for selectively exposing two or more adjacent compartments 26 of the container 22. In at least one still further embodiment, the cover 24 defines two or more cutouts 38 positioned and configured for selectively exposing two or more non-adjacent compartments 26 of the container 22. In at least one embodiment, as illustrated best in FIG. 1, each of the at least one cutout 38 is sized and shaped for approximating the dimensions of at least one compartment 26 of the container 22. However, it should be noted that in further embodiments, the at least one cutout 38 may take on any other size, shape, dimensions or quantities—now known or later developed—so long as the apparatus 20 is capable of substantially carrying out the functionality described herein; said size, shape, dimensions and quantity dictated at least in part by the corresponding size, shape and dimensions of at least one of the compartments 26, in at least one embodiment. In at least one further embodiment (not shown), a pair of opposing lateral edges 40 of the at least one cutout 38 (FIG. 2) each provides a cutout wall extending downwardly therefrom, toward the top surface 28 of the container 22. The cutout walls are configured for contacting any remaining items within a currently exposed compartment 26 (i.e., a compartment 26 over which said cutout 38 is currently positioned) that extend beyond the top surface 28 of the container 22, thereby preventing the container 22 from being rotated to the next at least one compartment 26 until said remaining items have been removed from the currently exposed compartment 26.

As mentioned above, the cover 24 is rotatably engagable with the container 22. In at least one embodiment, as illustrated best in FIG. 13B, the apparatus 20 is configured for allowing continuous, selective rotary motion of the container 22 relative to the cover 24 in only one direction (herein referred to as the "correct direction" D1), while substantially preventing motion in the opposite direction (herein referred to as the "incorrect direction" D2). In at least one such embodiment, as shown best in FIGS. 9, 10, 14A and 14B, the container 22 provides a circumferential flange 42 positioned and configured for being slidably engaged with a circumferential track 44 provided by an inner surface 46 of the cover 24, when the cover 24 is rotatably engaged with the container 22. In at least one alternate embodiment (not shown), the inner surface 46 of the cover 24 provides the flange 42 while the container 22 provides the track 44.

Figure 13B:
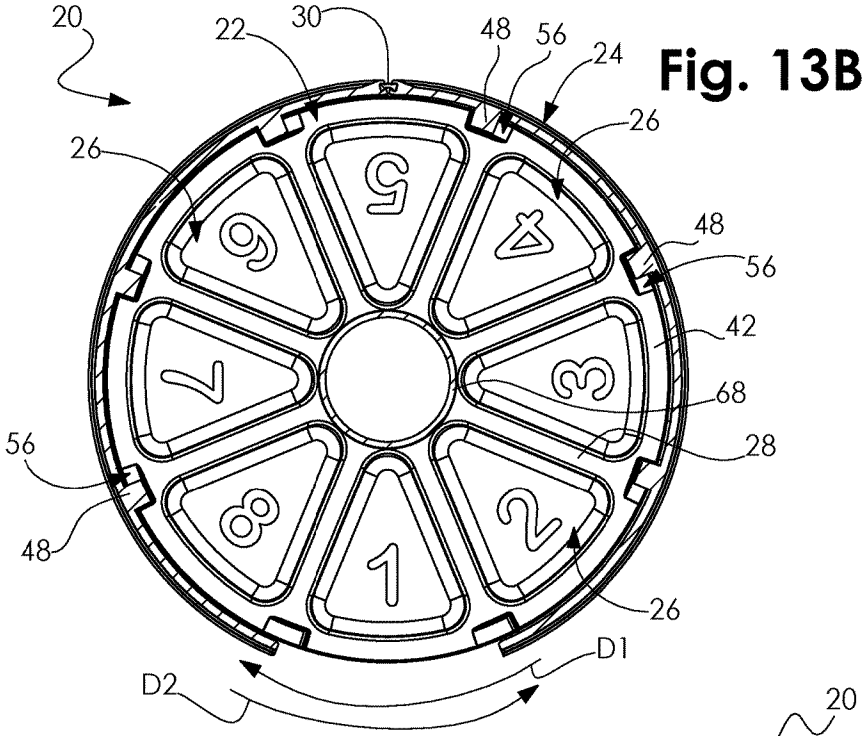
FIG. 13B is a cross-sectional view taken along line 13B-13B of FIG. 8A.

In at least one embodiment, the track 44 provides an at least one pair of opposing, spaced apart first and second track stops 48 and 50 (FIGS. 14A and 14B), such that the flange 42 rides between the at least one pair of first and second track stops 48 and 50 when the cover 24 is rotatably engaged with the container 22 (FIG. 13B). In at least one embodiment, the flange 42 provides an at least one catch 52. In at least one embodiment, the at least one first track stop 48 is positioned in a spaced apart relationship with the corresponding at least one second track stop 50, each pair of first and second track stops 48 and 50 positioned and configured for cooperating to substantially prevent the at least one catch 52 from moving in the incorrect direction D2. In at least one such embodiment, a first surface 54 of the at least one catch 52 defines a catch recess 56 configured for approximating the dimensions of the at least one first track stop 48, for selectively receiving said first track stop 48 therewithin, as discussed further below. Additionally, in at least one such embodiment, each of the opposing at least one second track stop 50 is asymmetrical in shape, having a sloped leading edge 58 configured for allowing an opposing second surface 60 of the at least one catch 52 to easily travel up and over the leading edge 58 when moving in the correct direction D1, and an opposing trailing edge 62 configured for selectively impeding the second surface 60 of the at least one catch 52 and substantially preventing said catch 52 from moving in the incorrect direction D2 thereafter. Thus, in at least one such embodiment, when the at least one catch 52 is moving in the correct direction D1, the second surface 60 of said catch 52 travels up along the leading edge 58 of a given second track stop 50 while the corresponding first track stop 48 indexes into the catch recess 56; upon said catch 52 clearing the leading edge 58 of said second track stop 50, gravity (or a mechanical force, in at least one embodiment, such as a spring for example) urges said catch 52 through a relatively narrow space 64 between the trailing edge 62 of said second track stop 50 and the corresponding first track stop 48, causing the catch recess 56 to move away from said first track stop 48 and allowing said catch 52 to continue moving in the correct direction D1 along the track 44. Should the at least one catch 52 be moved in the incorrect direction D2, the second surface 60 of said catch 52 will come into contact with the trailing edge 62 of the at least one second track stop 50, thereby preventing any further motion in the incorrect direction D2.

In at least one embodiment, each of the at least one catch 52, first track stop 48 and second track stop 50 are positioned relative to one another such that, upon the second surface 60 of the at least one catch 52 coming into abutting contact with the trailing edge 62 of the at least one second track stop 50, the at least one cutout 38 of the cover 24 is positioned directly over at least one compartment 26 of the container 22 (as best illustrated in FIG. 1)—depending on the size of said cutout 38 relative to the at least one compartment 26—thereby allowing access into said at least one compartment 26. Furthermore, in at least one embodiment, the apparatus 20 provides a plurality of catches 52, along with corresponding first and second track stops 48 and 50, positioned about the container 22 and cover 24 such that the at least one cutout 38 is sequentially positionable directly over each of the compartments 26 during a full rotation of the container 22 relative to the cover 24.

It should be noted that the particular size, shape, dimensions, relative position and quantity of each of the at least one catch 52, first track stop 48 and second track stop 50 depicted in the accompanying drawings are merely exemplary and shown for illustrative purposes. In further embodiments, each of the at least one catch 52, first track stop 48 and second track stop 50 may take on any other size, shape, dimensions, quantity or relative position—now known or later conceived—so long as the apparatus 20 is capable of substantially carrying out the functionality described herein. Similarly, the particular size, shape, dimensions and relative position of each of the circumferential flange 42 and track 44 depicted in the accompanying drawings is merely exemplary and shown for illustrative purposes. In further embodiments, each of the flange 42 and track 44 may take on any other size, shape, dimensions or relative position—now known or later conceived—so long as the apparatus 20 is capable of substantially carrying out the functionality described herein. In still further embodiments, any other mechanism, structure, or combination thereof—now known or later developed—capable of allowing the container 22 to be selectively rotatable relative to the cover 24 in only one direction may be substituted.

In at least one embodiment, as best illustrated in FIGS. 1 and 2, the apparatus 20 provides an at least one rotation mechanism 66 positioned and configured for assisting in the selective rotation of the container 22 relative to the cover 24. In at least one such embodiment, the at least one rotation mechanism 66 is a knob 68 affixed to the container 22 and configured for allowing the container 22 to be manually rotated via said knob 68. In at least one embodiment, the knob 68 is centrally positioned relative to the container 22 and extends upwardly therefrom through a corresponding knob aperture 70 in the cover 24, when the cover 24 is rotatably engaged with the container 22. It should be noted that the particular size, shape, dimensions, relative position and quantity of the at least one knob 68 depicted in the accompanying drawings—including the further embodiments illustrated in FIGS. 3-8—are merely exemplary and shown for illustrative purposes. In further embodiments, the at least one knob 68 may take on any other size, shape, dimensions, quantity or relative position (on either the container 22 or the cover 24)—now known or later conceived—so long as the apparatus 20 is capable of substantially carrying out the functionality described herein. Additionally, in further embodiments, the at least one rotation mechanism 66 may incorporate any other mechanism, structure, or combination thereof—now known or later developed—capable of allowing the container 22 to be selectively rotatable relative to the cover 24 in only one direction may be substituted. For example, in at least one such further embodiment (not shown), the at least one rotation mechanism 66 provides a selectively depressible button capable of axially rotating the container 22 or cover 24 through mechanical and/or electrical methods.

Figure 13A:
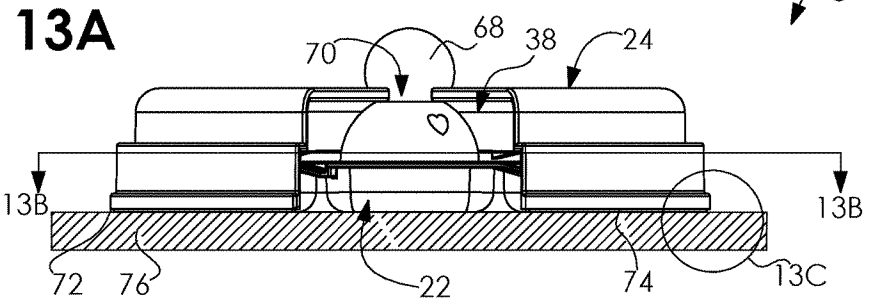
FIG. 13A is a side view of the exemplary cover rotatably engaged with the exemplary container, in accordance with at least one embodiment.
Figure 13C:
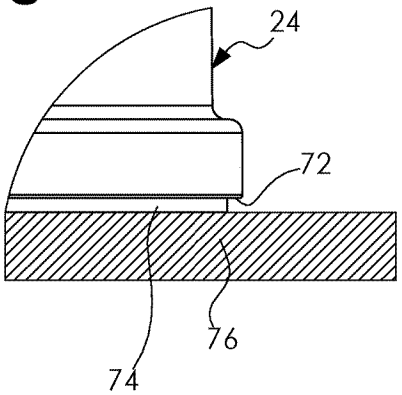
FIG. 13C is a detailed view of the section defined by line 13C of FIG. 8A.
Figure 14A:
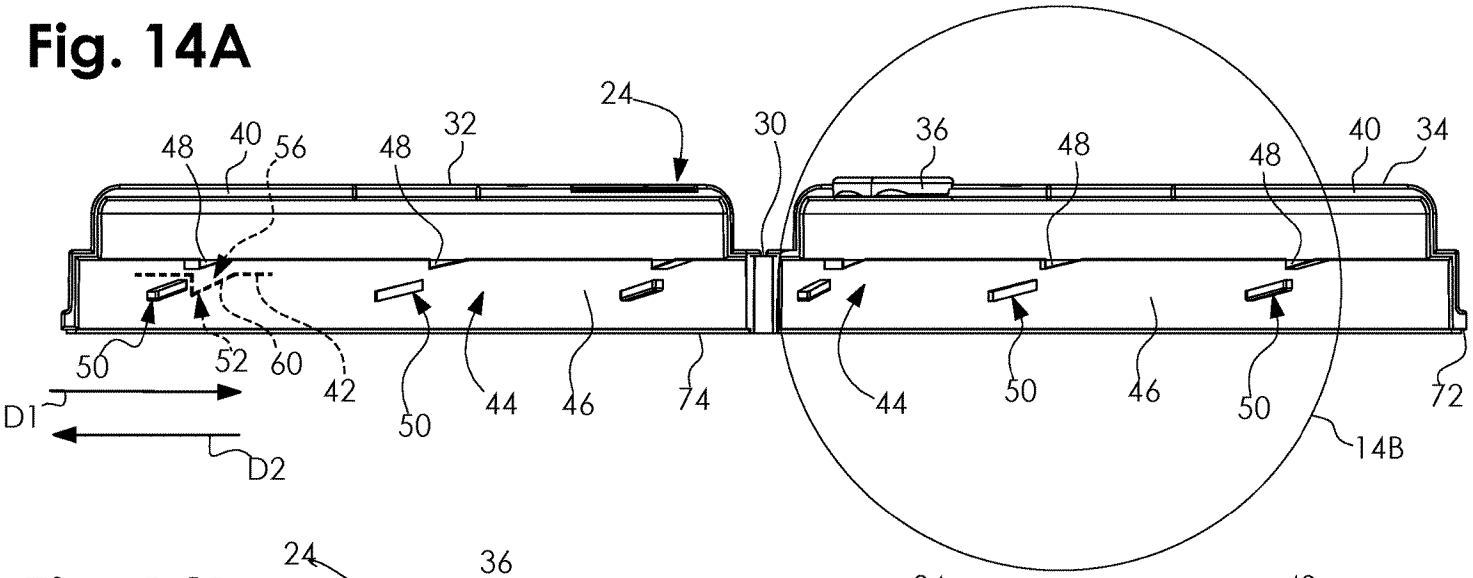
FIG. 14A is a side view of the exemplary cover in the open position, in accordance with at least one embodiment.
Figure 14B:
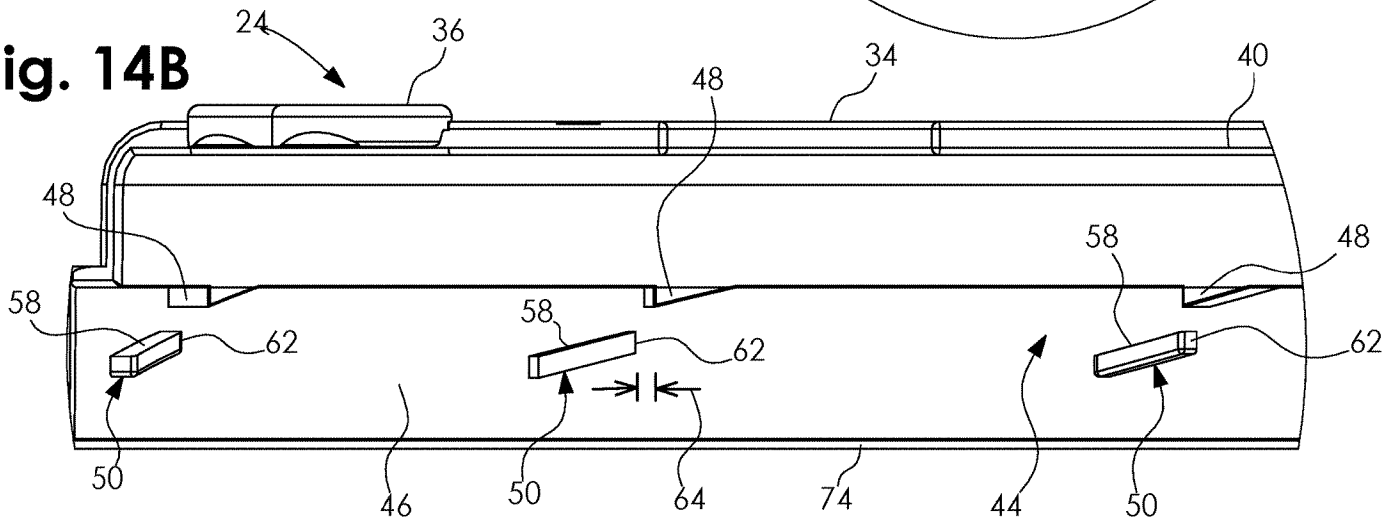
FIG. 14B is a detailed view of the section defined by line 14B of FIG. 14A.

In at least one embodiment, as shown best in FIGS. 13A and 13C, a bottom edge 72 of the cover 24 provides an at least one stabilizer 74 positioned and configured for preventing the cover 24 from unintentionally moving, relative to a surface 76 on which the apparatus 20 is positioned (such as a table, for example), during use of the apparatus 20. In at least one such embodiment, the at least one stabilizer 74 is constructed out of relatively high friction material, such as rubber for example. In a further such embodiment, the at least one stabilizer 74 is constructed out of a sticky or adhesive material. It should be noted that the particular size, shape, dimensions, relative position and quantity of the at least one stabilizer 74 depicted in the accompanying drawings are merely exemplary and shown for illustrative purposes. In further embodiments, the at least one stabilizer 74 may take on any other size, shape, dimensions, quantity or relative position—now known or later conceived—so long as the apparatus 20 is capable of substantially carrying out the functionality described herein. Additionally, in further embodiments, the at least one stabilizer 74 may incorporate any other mechanism, structure, material or combination thereof—now known or later developed—capable of preventing the cover 24 from unintentionally moving relative to the surface 76 may be substituted. For example, in at least one such further embodiment (not shown), the at least one stabilizer 74 may incorporate permanent engagement mechanisms (such as screws for example) or non-permanent engagement mechanisms (such as suction cups or magnets for example). In at least one further embodiment (not shown), a bottom surface 78 of the container 22 provides an at least one wheel or turntable positioned and configured for assisting in the rotation of the container 22 relative to the cover 24.

Figure 9:
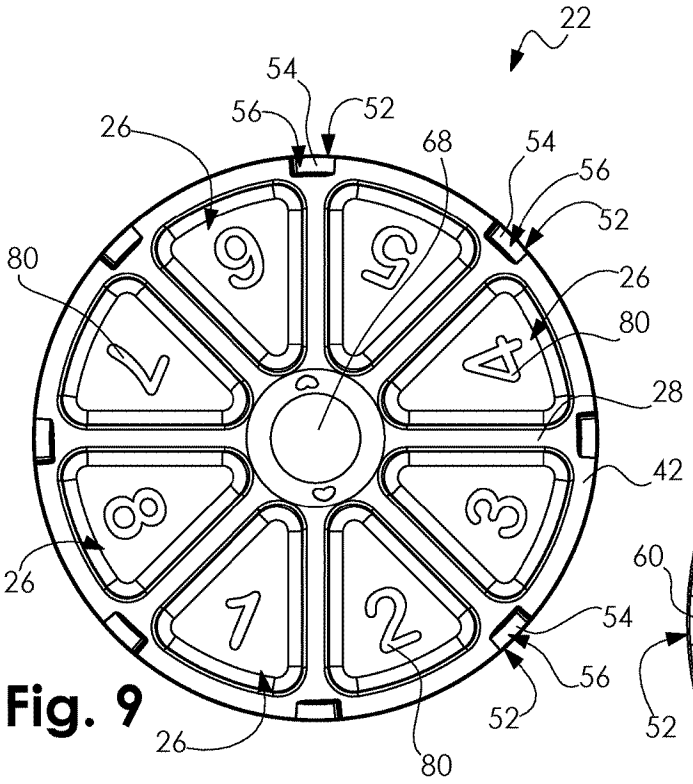
FIG. 9 is a top view of the exemplary container, in accordance with at least one embodiment.

In at least one embodiment, as best illustrated in FIG. 9, each of the compartments 26 provides indicia 80 configured for visually indicating the sequential order in which the compartments 26 are intended to be accessed during use of the apparatus 20. In at least one such embodiment, the indicia 80 are sequential numbers. It should be noted that the particular size, shape, dimensions, and relative position of the indicia 80 depicted in the accompanying drawings are merely exemplary and shown for illustrative purposes. In further embodiments, the indicia 80 may take on any other size, shape, dimensions or relative position—now known or later conceived—so long as the apparatus 20 is capable of substantially carrying out the functionality described herein. Additionally, in further embodiments, the indicia 80 may incorporate any other content—now known or later developed—substantially capable of functioning as a visual indicator with respect to the sequential order in which the compartments 26 are intended to be accessed during use of the apparatus 20.

As mentioned above, the apparatus 20 may be utilized in a variety of contexts where there is a desire to have the user access items in a progressive or sequential manner. In at least one context, the apparatus 20 may be used by a guardian to improve the eating habits of a child by requiring the child to eat a plurality of food items in a pre-defined sequential order. In at least one such context, the desired food items are selectively placed in each compartment 26 of the container 22, in the order in which they should be eaten by the child (based on the container 22 rotating in the correct direction D1 relative to the at least one cutout 38 in the cover 24), and then subsequently positions the container 22 within the cover 24. It should be noted that, in at least one embodiment, because the container 22 rotates relative to the substantially stationary cover 24, the apparatus 20 may be positioned such that the at least one cutout 38 remains directly in front of the child during use of the apparatus 20, thereby making it easier for the child to access the food items located in each sequential compartment 26 as the container 22 is selectively rotated. In at least one context, the order in which the food items are arranged is strategic in the sense that will require a non-preferred food to be consumed by the child prior to the child gaining access (via the at least one cutout 38) to a preferred food based on the rotation of the container 22 relative to the cover 24. An example of this would be for the guardian to alternate a non-preferred food item and preferred food item in adjacent compartments 26. By pairing non-preferred food items and preferred food in this way, the child will be motivated to consume the non-preferred food in order to gain access to, and consume, a preferred food. In at least one further context, the apparatus 20 may be used to promote balanced eating habits. This approach can be accomplished in a multitude of ways, of which, two will be described for illustrative purposes. The first approach is for a single compartment 26 to contain two or more food items which represent all or a portion of the offers of the specific meal for the child. This will create an environment in which the child is presented with a plurality of miniature meals which will each be consumed in its entirety prior to advancing to the next compartment 26 containing another miniature meal. This method facilitates balanced eating of foods which may or may not be of similar preference to the child. The second approach for using the apparatus 20 for balanced eating involves each compartment 26 containing primarily one food type. Adjacent compartments 26 contain foods of similar preference to the child and may or may not have a pattern of food types by compartment 26 throughout the order in which food is presented by the apparatus 20.

It should be noted, again, that the above non-limiting examples are provided for illustrative purposes only in order to facilitate a more complete understanding of representative embodiments now contemplated. These examples are intended to be a mere subset of all possible contexts in which the apparatus 20 may be utilized. Thus, these examples should not be construed to limit any of the embodiments described in the present specification, including those pertaining to use of the apparatus 20 in the context of food and/or methods and uses thereof. Ultimately, again, the apparatus 20 may be utilized in virtually any context (food-related or otherwise) where there is a desire to have the user access items in a progressive or sequential manner.

Aspects of the present specification may also be described as follows:

1. A container apparatus comprising: a container providing a plurality of compartments radially arranged about the container, each of the compartments being sized and configured for removably receiving an at least one item; a cover rotatably engagable with the container and configured for selectively covering and preventing access into at least one of the compartments; and the cover defining an at least one cutout positioned and configured for selectively exposing at least one compartment of the container, thereby allowing access into said at least one compartment; whereby, the apparatus is configured for allowing selective rotary motion of the container relative to the cover in a correct direction, while substantially preventing motion in an opposing incorrect direction.

2. The container apparatus according to embodiment 1, wherein the container provides a substantially planar top surface with each of the compartments being recessed within said top surface.

3. The container apparatus according to embodiments 1-2, wherein each of the compartments is removably positionable within a corresponding aperture in a top surface of the container.

4. The container apparatus according to embodiments 1-3, wherein the container provides a substantially planar top surface, with each of the compartments being defined by spaced apart partitions extending upwardly from the top surface of the container.

5. The container apparatus according to embodiments 1-4, wherein a top surface of the container is concave, with each of the compartments being defined by spaced apart partitions extending upwardly from the top surface of the container.

6. The container apparatus according to embodiments 1-5, wherein the cover provides an at least one hinge positioned and configured for allowing the cover to selectively move between one of a closed position, wherein a first half of the cover is in abutting contact with an opposing second half of the cover, and an open position, wherein the first and second halves of the cover are pivoted away from one another.

7. The container apparatus according to embodiments 1-6, wherein the cover further provides an at least one latch positioned and configured for preventing the cover from unintentionally moving into the open position during use of the apparatus.

8. The container apparatus according to embodiments 1-7, wherein each of the at least one cutout is positioned and configured for selectively exposing a single compartment of the container.

9. The container apparatus according to embodiments 1-8, wherein each of the at least one cutout is positioned and configured for selectively exposing two or more adjacent compartments of the container.

10. The container apparatus according to embodiments 1-9, wherein the cover defines two or more cutouts positioned and configured for selectively exposing two or more non-adjacent compartments of the container.

11. The container apparatus according to embodiments 1-10, wherein each of the at least one cutout is sized and shaped for approximating the dimensions of at least one compartment of the container.

12. The container apparatus according to embodiments 1-11, wherein a pair of opposing lateral edges of the at least one cutout each provides a cutout wall extending downwardly therefrom, toward the top surface of the container, said cutout walls configured for contacting any remaining items within a currently exposed compartment that extend beyond a top surface of the container.

13. The container apparatus according to embodiments 1-12, further comprising: a circumferential track provided by an inner surface of the cover; and a circumferential flange provided by the container, the flange positioned and configured for being slidably engaged with the track when the cover is rotatably engaged with the container.

14. The container apparatus according to embodiments 1-13, wherein: the track provides an at least one pair of opposing, spaced apart first and second track stops, such that the flange rides between the at least one pair of first and second track stops when the cover is rotatably engaged with the container; and the flange provides an at least one catch; whereby, each pair of first and second track stops is positioned and configured for cooperating to substantially prevent the at least one catch, and in turn the container, from moving in the incorrect direction.

15. The container apparatus according to embodiments 1-14, wherein a first surface of the at least one catch defines a catch recess configured for approximating the dimensions of the at least one first track stop, for selectively receiving said first track stop therewithin.

16. The container apparatus according to embodiments 1-15, wherein each of the opposing at least one second track stop provides a sloped leading edge configured for allowing an opposing second surface of the at least one catch to travel up and over the leading edge when moving in the correct direction, and an opposing trailing edge configured for selectively impeding the second surface of the at least one catch and substantially preventing said catch from moving in the incorrect direction thereafter.

17. The container apparatus according to embodiments 1-16, wherein each of the at least one catch, first track stop and second track stop are positioned relative to one another such that, upon the second surface of the at least one catch coming into abutting contact with the trailing edge of the at least one second track stop, the at least one cutout of the cover is positioned directly over at least one compartment of the container, thereby allowing access into said at least one compartment.

18. The container apparatus according to embodiments 1-17, further comprising a plurality of catches, and a plurality of corresponding first and second track stops, positioned about the container and cover such that the at least one cutout is sequentially positionable directly over each of the compartments during a full rotation of the container relative to the cover.

19. The container apparatus according to embodiments 1-18, further comprising an at least one rotation mechanism positioned and configured for assisting in the selective rotation of the container relative to the cover.

20. The container apparatus according to embodiments 1-19, wherein the at least one rotation mechanism is a knob affixed to the container and configured for allowing the container to be manually rotated via said knob.

21. The container apparatus according to embodiments 1-20, wherein the knob is centrally positioned relative to the container and extends upwardly therefrom through a corresponding knob aperture in the cover, when the cover is rotatably engaged with the container.

22. The container apparatus according to embodiments 1-21, wherein a bottom edge of the cover provides an at least one stabilizer positioned and configured for preventing the cover from unintentionally moving, relative to a surface on which the apparatus is positioned during use of the apparatus.

23. The container apparatus according to embodiments 1-22, wherein the at least one stabilizer is constructed out of relatively high friction material.

24. The container apparatus according to embodiments 1-23, wherein a bottom surface of the container provides one of an at least one wheel or turntable positioned and configured for assisting in the rotation of the container relative to the cover.

25. The container apparatus according to embodiments 1-24, wherein each of the compartments provides an indicia configured for visually indicating a sequential order in which the compartments are intended to be accessed during use of the apparatus.

26. The container apparatus according to embodiments 1-25, wherein the indicia are sequential numbers.

27. A container apparatus comprising: a container providing a plurality of compartments radially arranged about the container, each of the compartments being sized and configured for removably receiving an at least one item; a cover rotatably engagable with the container and configured for selectively covering and preventing access into at least one of the compartments; a circumferential flange positioned about the container and providing an at least one catch; a circumferential track positioned about an inner surface of the cover and providing an at least one pair of opposing, spaced apart first and second track stops, such that the flange, and in turn the container, rides between the at least one pair of first and second track stops in a correct direction, while the at least one catch substantially prevents the container from moving in an opposing incorrect direction; and the cover defining an at least one cutout positioned and configured for selectively exposing at least one compartment of the container, thereby allowing access into said at least one compartment.

28. A container apparatus comprising: a container providing a plurality of compartments radially arranged about the container, each of the compartments being sized and configured for removably receiving an at least one item; a cover rotatably engagable with the container and configured for selectively covering and preventing access into at least one of the compartments; a circumferential flange positioned about the container and providing an at least one catch; a circumferential track positioned about an inner surface of the cover and providing an at least one pair of opposing, spaced apart first and second track stops, such that the flange, and in turn the container, rides between the at least one pair of first and second track stops in a correct direction, while the at least one catch substantially prevents the container from moving in an opposing incorrect direction; a first surface of the at least one catch defines a catch recess configured for approximating the dimensions of the at least one first track stop, for selectively receiving said first track stop therewithin; each of the opposing at least one second track stop provides a sloped leading edge configured for allowing an opposing second surface of the at least one catch to travel up and over the leading edge when moving in the correct direction, and an opposing trailing edge configured for selectively impeding the second surface of the at least one catch and substantially preventing said catch, and in turn the container, from moving in the incorrect direction thereafter; and the cover defining an at least one cutout positioned and configured for selectively exposing at least one compartment of the container, thereby allowing access into said at least one compartment; whereby, each of the at least one catch, first track stop and second track stop are positioned relative to one another such that, upon the second surface of the at least one catch coming into abutting contact with the trailing edge of the at least one second track stop, the at least one cutout of the cover is positioned directly over at least one compartment of the container, thereby allowing access into said at least one compartment.

In closing, regarding the exemplary embodiments of the present invention as shown and described herein, it will be appreciated that a container apparatus is disclosed as providing a compartmentalized container and a ratcheting cover rotatably engagable therewith. Because the principles of the invention may be practiced in a number of configurations beyond those shown and described, it is to be understood that the invention is not in any way limited by the exemplary embodiments, but is generally directed to a container apparatus and is able to take numerous forms to do so without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention.

Certain embodiments of the present invention are described herein, including the best mode known to the inventor(s) for carrying out the invention. Of course, variations on these described embodiments will become apparent to those of ordinary skill in the art upon reading the foregoing description. The inventor(s) expect skilled artisans to employ such variations as appropriate, and the inventor(s) intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques. Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples, or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

When used in the claims, whether as filed or added per amendment, the open-ended transitional term "comprising" (along with equivalent open-ended transitional phrases thereof such as "including," "containing" and "having") encompasses all the expressly recited elements, limitations, steps and/or features alone or in combination with un-recited subject matter; the named elements, limitations and/or features are essential, but other unnamed elements, limitations and/or features may be added and still form a construct within the scope of the claim. Specific embodiments disclosed herein may be further limited in the claims using the closed-ended transitional phrases "consisting of" or "consisting essentially of" in lieu of or as an amendment for "comprising." When used in the claims, whether as filed or added per amendment, the closed-ended transitional phrase "consisting of" excludes any element, limitation, step, or feature not expressly recited in the claims. The closed-ended transitional phrase "consisting essentially of" limits the scope of a claim to the expressly recited elements, limitations, steps and/or features and any other elements, limitations, steps and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps and/or features specifically recited in the claim, whereas the meaning of the closed-ended transitional phrase "consisting essentially of" is being defined as only including those elements, limitations, steps and/or features specifically recited in the claim and those elements, limitations, steps and/or features that do not materially affect the basic and novel characteristic(s) of the claimed subject matter. Therefore, the open-ended transitional phrase "comprising" (along with equivalent open-ended transitional phrases thereof) includes within its meaning, as a limiting case, claimed subject matter specified by the closed-ended transitional phrases "consisting of" or "consisting essentially of." As such, embodiments described herein or so claimed with the phrase "comprising" are expressly or inherently unambiguously described, enabled and supported herein for the phrases "consisting essentially of" and "consisting of."

All patents, patent publications, and other publications referenced and identified in the present specification are individually and expressly incorporated herein by reference in their entirety for the purpose of describing and disclosing, for example, the compositions and methodologies described in such publications that might be used in connection with the present invention. These publications are provided solely for their disclosure prior to the filing date of the present application. Nothing in this regard should be construed as an admission that the inventors are not entitled to antedate such disclosure by virtue of prior invention or for any other reason. All statements as to the date or representation as to the contents of these documents is based on the information available to the applicants and does not constitute any admission as to the correctness of the dates or contents of these documents.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A container apparatus comprising:

a container providing a plurality of upwardly opening compartments radially arranged about the container, each of the compartments being sized and configured for removably receiving an at least one item;

a cover rotatably engagable with the container so as to restrict rotary motion of the container relative to the cover in a single, correct direction, the cover configured for selectively covering and preventing access into at least one of the compartments;

the cover defining an at least one cutout positioned and configured for selectively exposing at least one compartment of the container, thereby allowing access into said at least one compartment; and the cover providing an at least one hinge positioned and configured for allowing the cover to selectively move between one of a closed position, wherein a first half of the cover is in abutting contact with an opposing second half of the cover, and an open position, wherein the first and second halves of the cover are pivoted away from one another;

whereby, the apparatus is configured for allowing selective rotary motion of the container relative to the cover in the correct direction, thereby positioning each of the compartments under the at least one cutout in a sequential order, while preventing rotary motion of the container in an opposing incorrect direction.

2. The container apparatus of claim 1, wherein the container provides a substantially planar top surface with each of the compartments being recessed within said top surface.

3. The container apparatus of claim 1, wherein the container provides a substantially planar top surface, with each of the compartments being defined by spaced apart partitions extending upwardly from the top surface of the container.

4. The container apparatus of claim 1, wherein a top surface of the container is concave, with each of the compartments being defined by spaced apart partitions extending upwardly from the top surface of the container.

5. The container apparatus of claim 1, wherein the cover further provides an at least one latch positioned and configured for preventing the cover from unintentionally moving into the open position during use of the apparatus.

6. The container apparatus of claim 1, wherein each of the at least one cutout is sized and shaped for approximating the dimensions of at least one compartment of the container.

7. The container apparatus of claim 1, further comprising:

a circumferential track provided by an inner surface of the cover; and a circumferential flange provided by the container, the flange positioned and configured for being slidably engaged with the track when the cover is rotatably engaged with the container.

8. The container apparatus of claim 7, wherein:

the track provides an at least one pair of opposing, spaced apart first and second track stops, such that the flange rides between the at least one pair of first and second track stops when the cover is rotatably engaged with the container; and the flange provides an at least one catch;

whereby, each pair of first and second track stops is positioned and configured for cooperating to substantially prevent the at least one catch, and in turn the container, from moving in the incorrect direction.

9. The container apparatus of claim 8, wherein a first surface of the at least one catch defines a catch recess configured for approximating the dimensions of the at least one first track stop, for selectively receiving said first track stop therewithin.

10. The container apparatus of claim 9, wherein each of the opposing at least one second track stop provides a sloped leading edge configured for allowing an opposing second surface of the at least one catch to travel up and over the leading edge when moving in the correct direction, and an opposing trailing edge configured for selectively impeding the second surface of the at least one catch and substantially preventing said catch from moving in the incorrect direction thereafter.

11. The container apparatus of claim 10, wherein each of the at least one catch, first track stop and second track stop are positioned relative to one another such that, upon the second surface of the at least one catch coming into abutting contact with the trailing edge of the at least one second track stop, the at least one cutout of the cover is positioned directly over at least one compartment of the container, thereby allowing access into said at least one compartment.

12. The container apparatus of claim 11, further comprising a plurality of catches, and a plurality of corresponding first and second track stops, positioned about the container and cover such that the at least one cutout is sequentially positionable directly over each of the compartments during a full rotation of the container relative to the cover.

13. The container apparatus of claim 1, further comprising an at least one rotation mechanism positioned and configured for assisting in the selective rotation of the container relative to the cover.

14. The container apparatus of claim 13, wherein the at least one rotation mechanism is a knob affixed to the container and configured for allowing the container to be manually rotated via said knob.

15. The container apparatus of claim 14, wherein the knob is centrally positioned relative to the container and extends upwardly therefrom through a corresponding knob aperture in the cover, when the cover is rotatably engaged with the container.

16. The container apparatus of claim 1, wherein a bottom edge of the cover provides an at least one stabilizer positioned and configured for preventing the cover from unintentionally moving, relative to a surface on which the apparatus is positioned during use of the apparatus.

17. The container apparatus of claim 1, wherein each of the compartments provides an indicia configured for visually indicating a sequential order in which the compartments are intended to be accessed during use of the apparatus.

18. A container apparatus comprising:

a container providing a plurality of compartments radially arranged about the container, each of the compartments being sized and configured for removably receiving an at least one item;

a cover rotatably engagable with the container and configured for selectively covering and preventing access into at least one of the compartments;

a circumferential flange positioned about the container and providing an at least one catch;

a circumferential track positioned about an inner surface of the cover and providing an at least one pair of opposing, spaced apart first and second track stops, such that the flange, and in turn the container, rides between the at least one pair of first and second track stops in a correct direction, while the at least one catch substantially prevents the container from moving in an opposing incorrect direction; and the cover defining an at least one cutout positioned and configured for selectively exposing at least one compartment of the container, thereby allowing access into said at least one compartment.

19. A method for a user to consume a plurality of food items in a desired order utilizing the container apparatus of claim 1, the method comprising the steps of:

a) selectively placing each of the food items into the desired compartments of the container;

b) engaging the cover with the container;

c) positioning the apparatus so that the cutout of the cover is positioned proximal to the user;

d) rotating the container relative to the cover, while the cover remains substantially stationary, until the compartment containing a first of the food items to be consumed is positioned directly under the cutout of the cover;

e) consuming the food items within the compartment over which the cutout is positioned;

f) rotating the container relative to the cover until a further one of the compartments is positioned directly under the cutout; and g) repeating steps (e)-(f) until the user elects to stop, or until all food items in the container have been consumed.

* * * * *